US006345782B1

(12) United States Patent
Nakayama et al.

(10) Patent No.: US 6,345,782 B1
(45) Date of Patent: Feb. 12, 2002

(54) PRINTER AND CONTROL METHOD FOR THE SAME

(75) Inventors: Hiroyuki Nakayama, Shiojiri; Kohei Osawa, Suwa, both of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/411,333

(22) Filed: Oct. 1, 1999

(30) Foreign Application Priority Data

Oct. 2, 1998 (JP) ..... 10-281797
Oct. 2, 1998 (JP) ..... 10-281799

(51) Int. Cl.[7] ..... B65H 23/00

(52) U.S. Cl. ..... 242/564.4; 400/549; 400/605; 400/607.2

(58) Field of Search ..... 242/564.4; 347/218; 346/136; 400/594, 605, 607, 607.2, 595, 613, 636, 637.1

(56) References Cited

U.S. PATENT DOCUMENTS 5,061,095 A 10/1991 Asai et al.
5,400,146 A 3/1995 Otsuki et al.

FOREIGN PATENT DOCUMENTS

| | | |
|---|---|---|
| EP | 0 925 947 | 6/1999 |
| JP | 63098451 | 4/1988 |
| JP | 2-59534 | 5/1990 |
| JP | 4-13371 | 2/1992 |
| JP | 4-351156 | 12/1992 |
| JP | 5-147284 | 6/1993 |
| JP | 6-79855 | 10/1994 |
| JP | 7-309506 | 11/1995 |
| JP | 8-18705 | 1/1996 |
| JP | 10-20414 | 1/1998 |

*Primary Examiner*—William A. Rivera

(57) ABSTRACT

A printer in which a cover to the roll paper holder in which roll paper is held can be easily opened even when such problems as a roll paper jam occur. Opening and closing a cover (30) to the roll paper loading mechanism (2) of the printer is detected by a photointerrupter (288) detecting whether the locking lever (280) is in a locked or unlocked position. When the lock is unlocked, an cover unlocked signal is asserted to the drive control unit (39). The drive control unit (39) then drives a solenoid (62B) to switch the drive motor (61) torque transfer path from the roll paper gear train to the slip form gear train. This disengages a first gear (71) on the printer and an engaging paper.

11 Claims, 15 Drawing Sheets

FIG. 12A
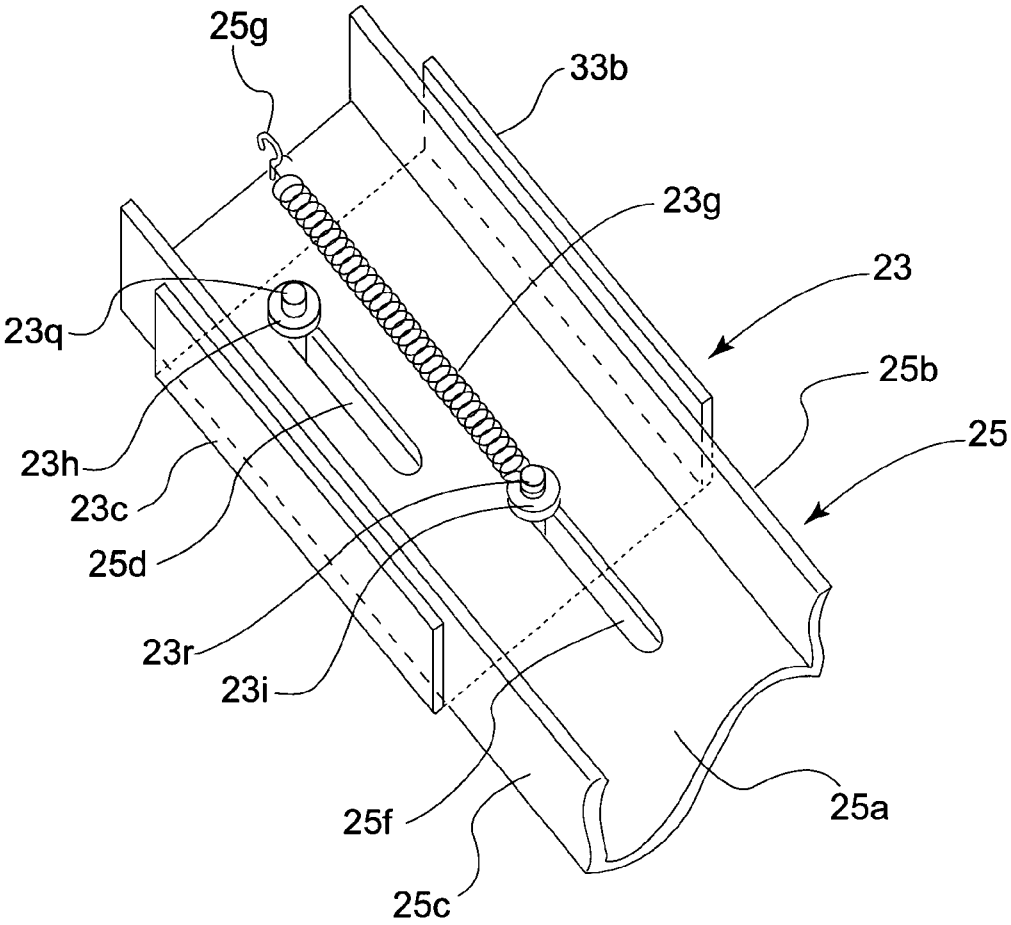
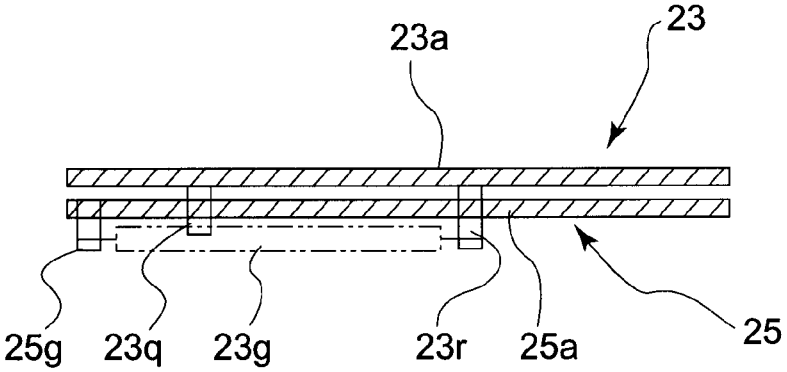
FIG. 12B

PRINTER AND CONTROL METHOD FOR THE SAME

BACKGROUND OF THE INVENTION

1. Field of the Invention

The present invention relates generally to a printer capable of printing on roll paper and used typically in a point-of-sale (POS) terminal. More specifically, the present invention relates to a printer in which a cover to the roll paper holder in which roll paper is held can be easily opened even when such problems as a roll paper jam occur.

2. Description of the Related Art

Printers for printing to roll paper using an ink jet head, wire dot head, or thermal head for the print head are known in the literature. As taught in JP-A 5-147284, there are also printers capable of printing to both roll paper and slip forms. A printer having a mechanism for switching rotation of a common paper transportation drive motor between a roll paper transportation mechanism and a slip form transportation mechanism is also known from U.S. Pat. No. 5,061,095, for example.

A recording apparatus having a roll paper loading mechanism whereby the cover closing the opening to the roll paper holder of the printer can be fully opened so that replacing or loading roll paper can be accomplished easily is also taught in JP-B 6-79855. It should be noted that the taught recording apparatus has the platen roller (roll paper feed roller), which is pressed against the thermal head, mounted to the edge of the cover to the roll paper holder. The platen roller is also removed from the opening to the roll paper holder when this cover is opened, thus completely exposing the roll paper holder opening. Roll paper can therefore be easily loaded into the holder from a completely unobstructed opening.

When the platen roller is mounted on the cover to the roll paper holder and the cover is then closed, the paper feed gear mounted coaxially to the platen roller engages the last gear (drive gear) in the roll paper transportation gear train on the printer.

In order for these gears to engage, the freely turning paper feed gear first approaches and then contacts the drive gear, and then typically turns a short distance until the teeth on the two gears mesh. Because the platen roller is integrally attached to the paper feed gear, the platen roller also turns slightly as the paper feed gear engages the drive gear. When the cover is opened, the paper feed gear likewise rotates a short distance in the opposite direction to disengage the paper feed gear from the drive gear. The platen roller obviously also turns in the opposite direction at the same time.

JP-A 10-20414 further teaches a cover opening/closing mechanism comprising a cover rotationally attached to the body of a facsimile machine, for example, and an interlock sensor for detecting whether this cover is open or closed. The cover of this cover opening/closing mechanism has a locking means for holding the cover closed to an opposing member. When a release lever for this locking means is operated, the lock is released and the lock and cover separate from the opposing member. The interlock sensor detects that the cover lock has been released.

When the cover is opened to replace the roll paper in a conventional printer having a platen roller and paper feed gear mounted on the cover to the roll paper holder, the paper feed gear for the platen roller mounted to the holder cover rotates slightly so that it is released from engagement with the drive gear train of the printer. It is important to note, however, that the drive gear is always linked to the drive motor through the intervening roll paper transportation gear train. This means that rotation of the drive gear is normally constrained.

In order to open the cover with such a printer, it is therefore necessary to disengage the paper feed gear from the engaged drive gear by working against the motor torque constraining gear movement. Much force is therefore required to open the cover, and the cover cannot be easily opened.

When roll paper jams in such a printer, the paper is typically advanced into and becomes jammed in a gap between the platen roller and another member. When the paper becomes thus jammed, it becomes very difficult if not practically impossible to turn the platen roller and the paper feed gear attached coaxially thereto.

When the user attempts to open the cover in order to remove the jammed roll paper, the paper feed gear will not turn and therefore cannot disengage from the drive gear. It is therefore very difficult if not impossible to open the cover.

OBJECTS OF THE INVENTION

Therefore, it is an object of the present invention to overcome the aforementioned problems.

With consideration for the above noted problems, it is an object of the present invention to provide a printer in which the cover to a roll paper holder can be opened using little force.

It is a further object of the present invention to provide a printer in which the cover to a roll paper holder can be opened using little force even when rotation of the roll paper feed roller is constrained due to a roll paper jam.

SUMMARY OF THE INVENTION

To achieve these and other objects, a printer according to the present invention comprises: a roll paper holder including an opening for loading the a roll paper, a cover movably supported on the roll paper holder, the cover allowed to move between a closed position where the opening is closed and an opening position where the opening is open, a roll paper feed roller attached to the cover, a motor for rotationally driving the roll paper feed roller, and a roll paper transportation gear train (first gear train) for transferring motor rotation to the roll paper feed roller. This roll paper transportation gear train has a drive gear (first gear) mounted to the roll paper holder, and a paper feed gear (second gear) mounted to the cover for engaging said drive gear when the cover is closed. The printer additionally comprises: a locking mechanism (cover lock) for locking the cover closed; a detector for detecting that the cover lock is unlocked; and a controller for reducing a constraining force exerted to the second gear, which constrains free rotation of the first gear, when the detector detects that the cover lock is unlocked.

When the detector detects that the cover lock is unlocked, the controller preferably drives the motor so as to stop supply of a holding current to said motor.

Alternatively, the controller preferably drives the motor for a specific time in a direction opposite the roll paper advancing direction.

Yet further alternatively, a clutch for disengaging the first gear train from the motor is provided, and the controller disengages the clutch when the detector detects that the cover lock is unlocked.

The clutch in this case preferably comprises a solenoid and a switching gear, and the controller controls solenoid operation. The switching gear can be slid by the solenoid between a roll paper transportation position (first position) where the switching gear engages a gear in the roll paper transportation gear train and a second position at which the switching gear is separated from the roll paper transportation gear train.

When the cover lock in a printer according to the present invention is unlocked, force constraining opening of the cover can thus be reduced or released by stopping the supply of the holding current holding the motor in a particular position, driving the motor in reverse, or disengaging the drive motor from the roll paper transportation gear train.

When the motor holding current is stopped and when the drive motor is disengaged from the roll paper transportation gear train, the drive motor no longer constrains and prevents the roll paper transportation gear train from turning freely. The load on the last drive gear in this gear train is therefore extremely small, enabling the gears to turn freely or with substantially no resistance. As a result, the paper feed gear engaged with this drive gear can also turn extremely easily, and can be disengaged from the drive gear with little force required. As a result, the force required to open the cover is extremely small.

When the motor is driven in reverse, the paper feed gear is forcibly turned for a specific time in the direction in which the cover opens. As a result, the paper feed gear and drive gear are disengaged, and the force required to open the cover is small.

The driving of the of motor in reverse is particularly effective when roll paper becomes jammed and the roll paper feed roller is constrained from turning. Even if the paper feed gear linked to the roll paper feed roller will not turn at this time, the drive gear will. Engagement of the two gears can thus be easily released. The jammed roll paper can also be easily removed by reversing the motor.

In a preferred embodiment of the present invention, the printer further comprises a slip form feed roller; a slip form transportation gear train (second gear train) for transferring motor rotation to the slip form feed roller; and a clutch for selectively engaging the motor to the roll paper transportation gear train or the slip form transportation gear train. The controller in this case drives the clutch to engage the motor to the slip form transportation gear train.

When the cover lock is released in a printer thus comprised, the roll paper transportation gear train is disconnected from the motor. The constraining force of the motor on the roll paper transportation gear train is thus released or reduced, and the last gear in the gear train can turn easily. Little force is therefore required to release the paper feed gear from the drive gear when opening the cover, and the operating force required to open the cover can be reduced.

The clutch can alternatively comprise a solenoid; a switching gear that can be slid by said solenoid between a roll paper transportation position (first position) and a slip form transportation position (second position); a gear in the roll paper transportation gear train for engaging said switching gear in the roll paper transportation position; and a gear in the slip form transportation gear train for engaging said switching gear in the slip form transportation position.

Further preferably, the locking mechanism of this printer according to the present invention comprises a locking lever for locking the cover closed; a pivot pin pivotably supporting said locking lever to pivot between a locked position and an unlocked position; a hook formed as part of the locking lever; and a catch on the roll paper holder for catching the hook when the locking lever reaches the locked position.

Yet further preferably in this case, the detector comprises a pivoting lever, and an optical sensor for detecting the pivoting lever. This pivoting lever is supported in the roll paper holder so that it is positioned in the detection range of the optical sensor when the locking lever is in the locked position, and moves out of this detection range when the locking lever is unlocked.

When thus comprised and the cover will not open because of a roll paper jam, the cover can be easily unlocked by simply operating the locking lever whereby the cover locked closed. The constraining force preventing the paper feed gear from turning can thus be released or reduced without actually moving the cover.

A control method for a printer according to the present invention has steps corresponding to the features of the printer described above, and thus achieves the same results described above.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

FIGS. 12A and 12B show the slide frame for the cover frame of the roll paper loading mechanism in FIG. 7;

DESCRIPTION OF THE PREFERRED EMBODIMENTS

A preferred embodiment of an ink jet printer for a POS terminal according to the present invention is described below with reference to the accompanying figures.

General Configuration of an Ink Jet Printer

Figure 1:
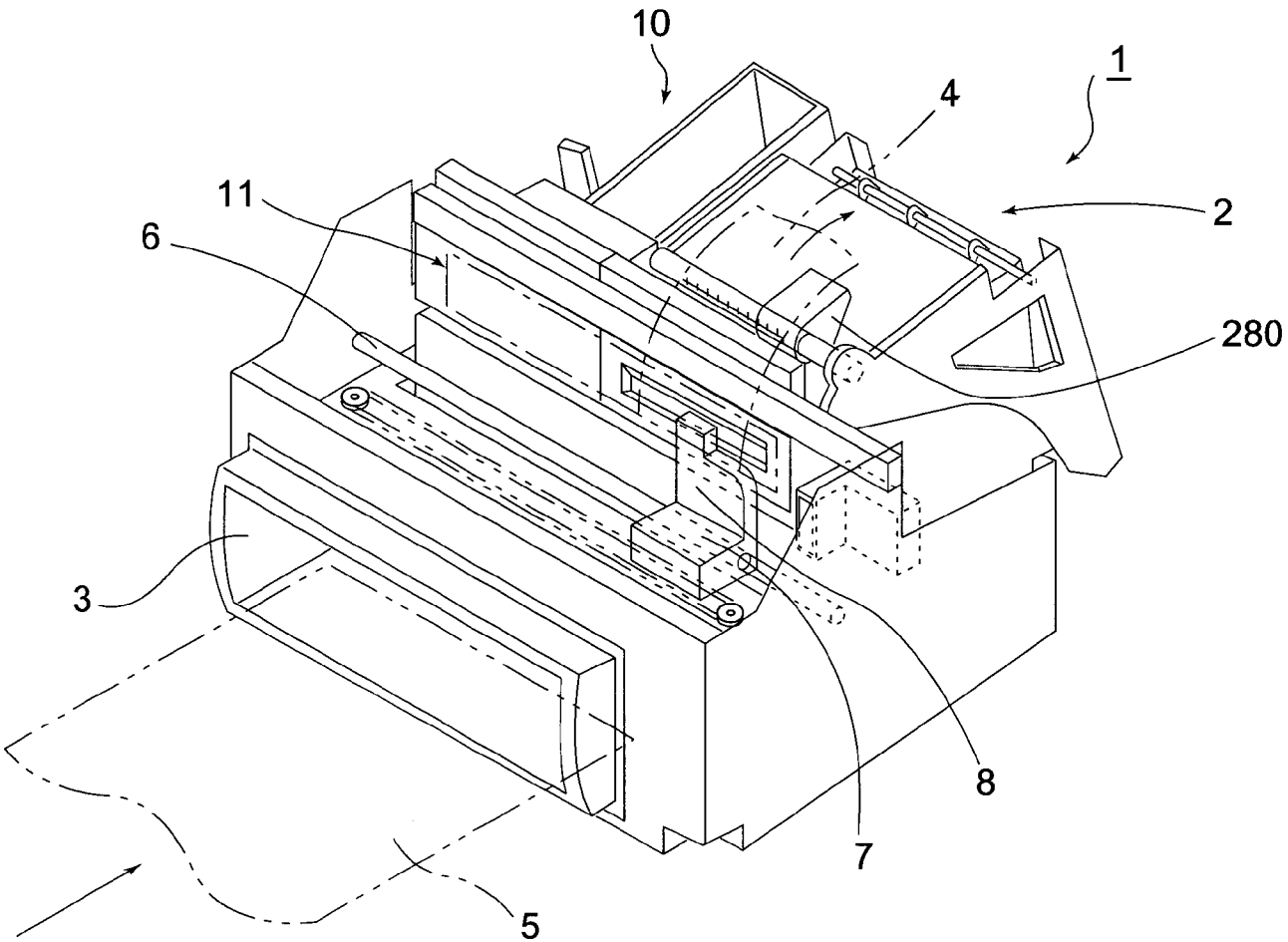
FIG. 1 is a perspective view of an ink jet printer according to a first preferred embodiment of the present invention.
Figure 2:
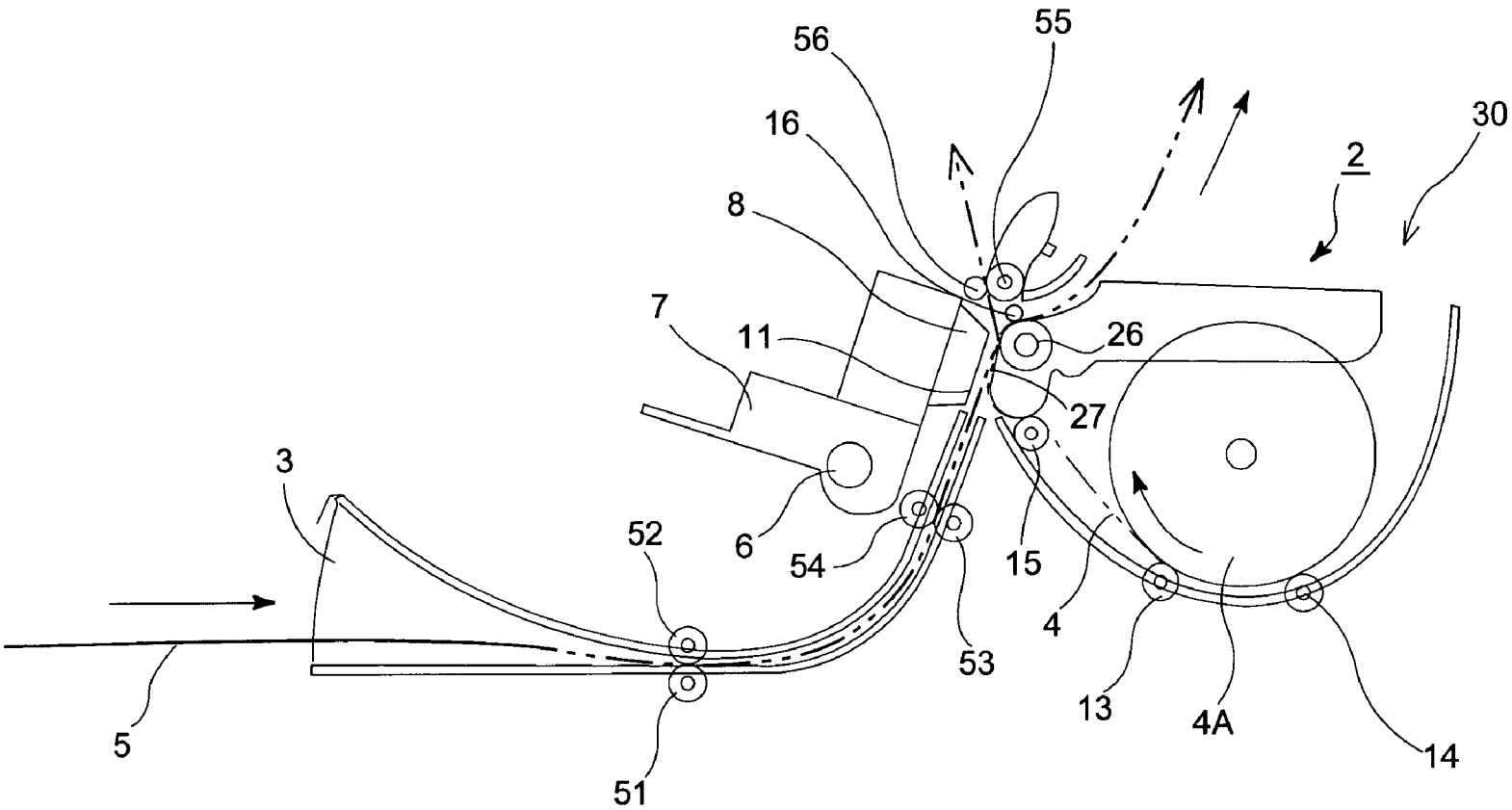
FIG. 2 shows the paper transportation path in the ink jet printer shown in FIG. 1.

FIG. 1 is a perspective view of an ink jet printer according to a first preferred embodiment of the present invention, and FIG. 2 shows the paper transportation path in the ink jet printer shown in FIG. 1. As shown in these figures, the paper transportation path of an ink jet printer 1 according to this preferred embodiment of the invention has a roll paper loading mechanism 2 and a slip form insertion opening 3 for inserting A4 size and other cut-sheet forms. The transportation path carries roll paper 4 supplied from the roll paper loading mechanism 2, or a slip form 5 inserted from the slip form insertion opening 3, past a common printing position 11 (indicated in FIG. 1 by a single dot-dash line).

Roll paper 4 is typically used for printing receipts. The roll paper 4 is pulled from a paper roll 4A loaded in the roll paper loading mechanism 2, travels between paper guide 27 and pressure roller 15, past the printing position 11, and between the platen roller 26 (also referred to as the roll paper feed roller) and pressure roller 16. Note that the roll paper 4 is advanced by rotation of the platen roller 26.

Slip forms 5 are used for printing sales records and similar forms. A slip form 5 is inserted from the slip form insertion opening 3 and caught by paper feed roller 51 and follower 52, advanced between paper feed roller 53 and follower 54 past the printing position 11, and is then advanced out from the printer between paper feed roller 55 and follower 56 (see FIG. 3).

A guide shaft 6 is disposed parallel to the common printing position 11. An ink jet head 8 is mounted on a carriage 7, which travels bidirectionally along the guide shaft 6. It is therefore possible to print as desired to the surface of either roll paper 4 or slip form 5 advanced to the common printing position 11 by means of this ink jet head 8.

Ink is supplied through an ink tube (not shown in the figure) to the ink jet head 8 from an ink supply 10 disposed at a position typically adjacent to the roll paper loading mechanism 2.

Drive Transfer Assembly

A typical configuration for a drive transfer assembly used in a ink jet printer 1 according to this preferred embodiment of the invention is described next with reference to FIGS. 3, 4A and 4B. This drive transfer assembly uses a clutch mechanism 96 to transfer rotational energy (torque) from a single drive motor 61 to the gear train for roll paper transportation 97 or gear train for slip form transportation 95, thereby rotationally driving platen roller 26, that is the roll paper feed roller, and paper feed rollers 51, 53, and 55 for slip form transportation. For convenience, the locations of platen roller 26 and paper feed rollers 51, 53, and 55 are shaded in FIG. 3.

Figure 3:
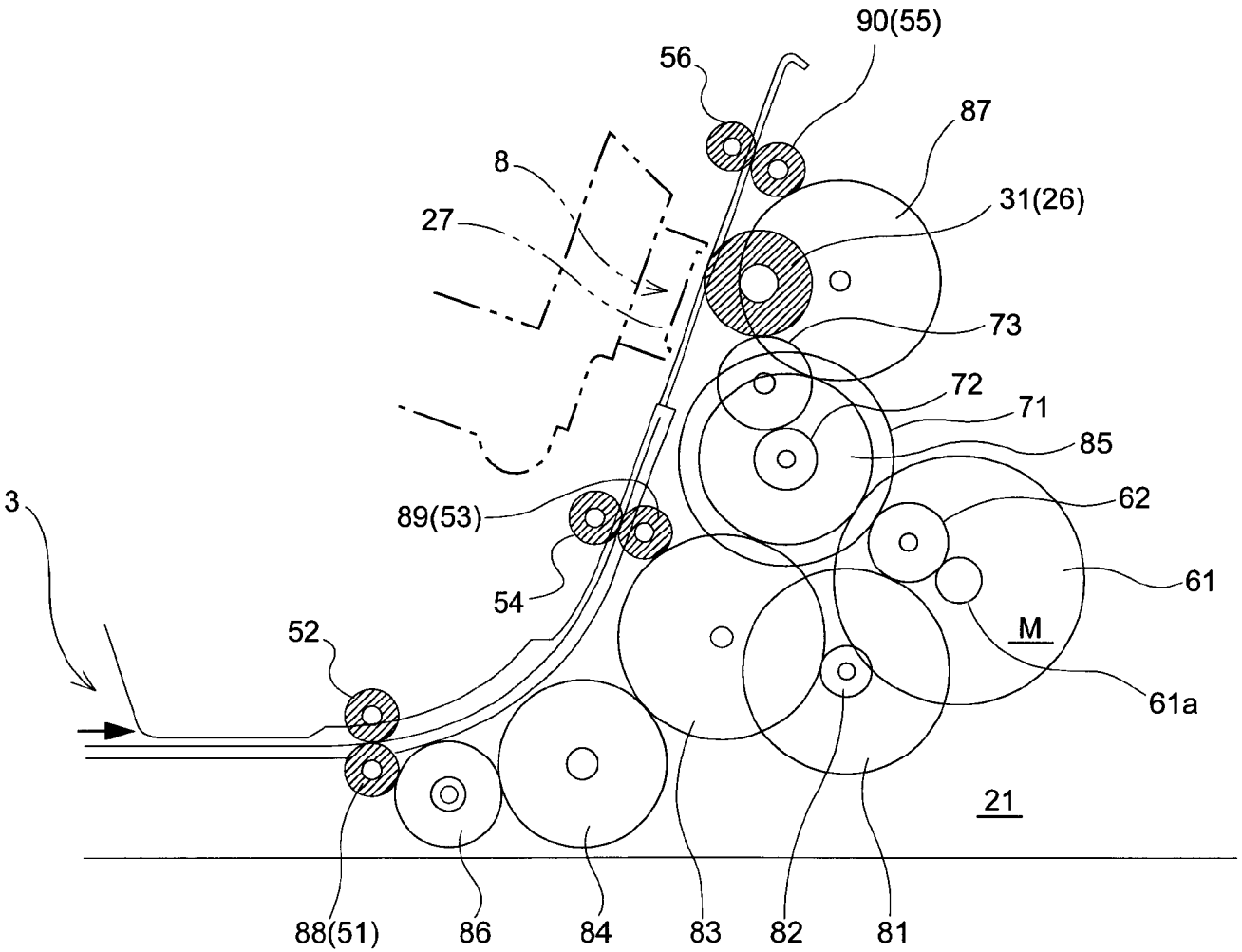
FIG. 3 is a typical side view of the drive force transfer mechanism in the ink jet printer shown in FIG. 1.
Figure 4A:
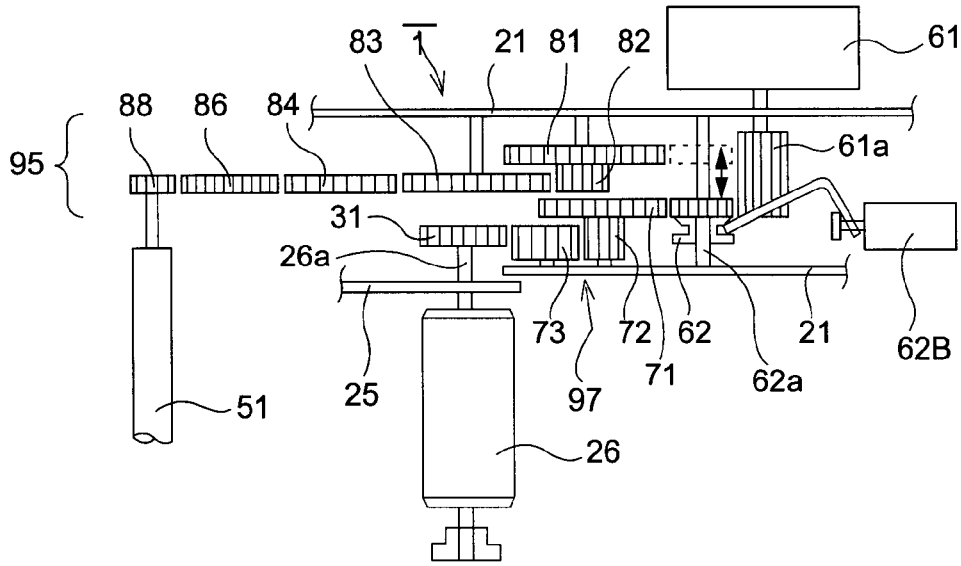
FIG. 4A is a typical top view of the drive force transfer mechanism in the ink jet printer shown in FIG. 1.
Figure 4B:
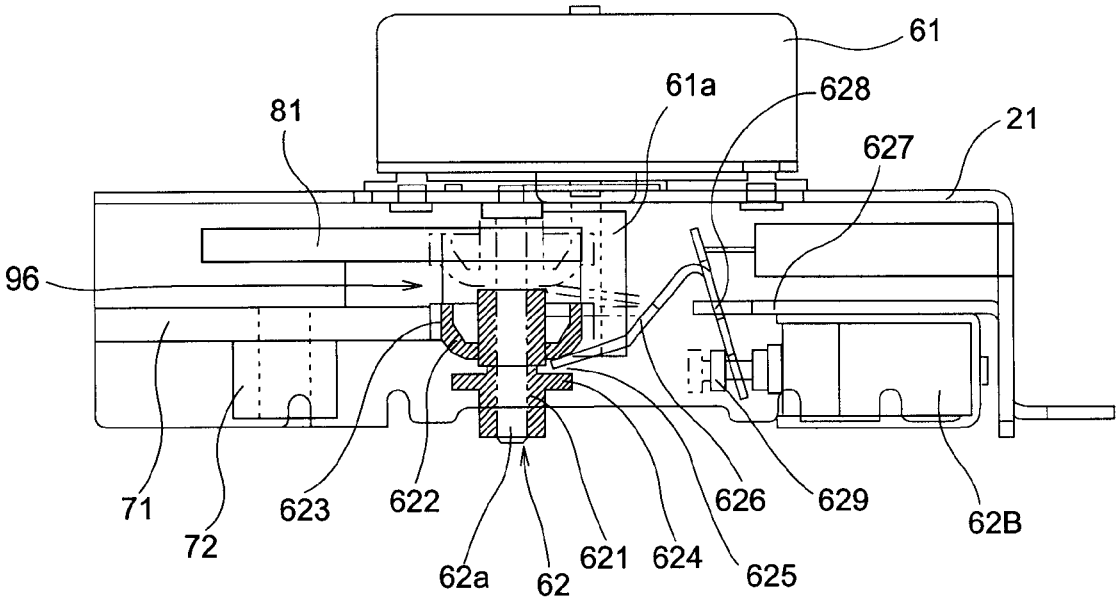
FIG. 4B shows an exemplary clutch mechanism of the drive force transfer mechanism.

Referring to FIGS. 3, 4A and 4B, the drive transfer assembly comprises a single drive motor 61; roll paper transportation gear train 97 for transferring motor rotational energy from a pinion gear 61*a* on the motor shaft to the platen roller 26; a slip form transportation gear train 95 for transferring this motor rotation to paper feed rollers 51, 53, and 55; and a switching gear 62 for switching motor rotation between these two gear trains 95 and 97. It is to be noted that this switching gear 62 constantly engages the pinion gear 61*a* on the motor shaft.

Gear train 97 for roll paper transportation includes a first gear 71 for engaging switching gear 62; a second gear 72 linked coaxially to first gear 71; a third gear, referred to as the drive gear 73, engaged with this second gear 72; and a paper feed gear 31, which is engaged with the drive gear 73, for driving platen roller 26. Paper feed gear 31 for platen roller drive is fixed on and coaxially to the end of center shaft 26*a* of platen roller 26.

As described more fully below, platen roller 26 is mounted on an end of a slide frame 25, which is a component of the opening/closing cover for roll paper loading mechanism 2. When opening/closing cover 30 is completely closed and locked, the paper feed gear 31 mounted on the end of the center shaft 26*a* of the platen roller 26 engages the drive gear 73, which is the last gear in gear train 97 on the printer side.

Gear train 95 for slip form transportation includes a first gear 81 for engaging switching gear 62; a second gear 82 linked coaxially to this first gear 81; a third gear 83 engaging this second gear 82; fourth and fifth gears 84 and 85 engaging this third gear 83; a sixth gear 86 engaging this fourth gear 84; a seventh gear 87 engaging this fifth gear 85; a paper feed roller drive gear 88 engaging this sixth gear 86; a paper feed roller drive gear 89 engaging the third gear 83; and a paper feed roller drive gear 90 engaging the seventh gear 87. The paper feed roller drive gear 88 is linked coaxially to paper feed roller 51; paper feed roller drive gear 89 is linked coaxially to paper feed roller 53; and paper feed roller drive gear 90 is linked coaxially to paper feed roller 55.

The clutch mechanism for switching the transfer path of drive motor 61 torque (referred to as the drive train below) is described next below with reference to FIGS. 4A and 4B. This clutch mechanism comprises the above-noted switching gear 62, and a solenoid 62B for moving the switching gear 62 along center shaft 62*a* between a roll paper transportation position, that is, the gear 62 position indicated in FIG. 4A by a solid line, and a slip form transportation position, that is, the gear 62 position indicated by a dotted line in FIG. 4A.

As shown in FIG. 4B, the switching gear 62 comprises a cylindrical part 621 disposed so that it can rotate freely and slide on center shaft 62*a*; external gear 623 formed on the outside circumference surface of ring flange 622, which is cupped to widen from the outside circumference surface of cylindrical part 621; and a ring flange 624 formed at a position on the outside circumference of cylindrical part 621 separated in the axial direction from ring flange 622. An annular channel 625 is formed between these ring flanges 622 and 624. An end of operating lever 626 whereby switching gear 62 is slid along the shaft is inserted to this annular channel 625.

The other end of this operating lever 626 is linked to an end part of operating rod 629 of solenoid 62B by way of intervening lever support 628 formed to support bracket 627. It is therefore possible to slide the switching gear 62 and thereby switch the drive train by simply appropriately controlling operation of the solenoid 62B.

As will be understood from FIGS. 3, 4A and 4B, motor rotation is transferred through first to third gears 71, 72, and 73 to the last paper feed gear 31 when the switching gear 62 is in the roll paper transportation position (indicated by the solid line in FIG. 4A). Platen roller 26 is thus rotationally driven, and roll paper 4 is advanced.

When the switching gear 62 is moved to the slip form transportation position (indicated by the dotted line in FIG. 4A), motor rotation is transferred through first to seventh gears 81 to 87 to paper feed roller drive gears 88, 89, and 90, and the corresponding paper feed rollers 51, 53, and 55 are thus rotationally driven. In this case, slip form 5 is advanced.

Switching the Drive Train

Figure 5:
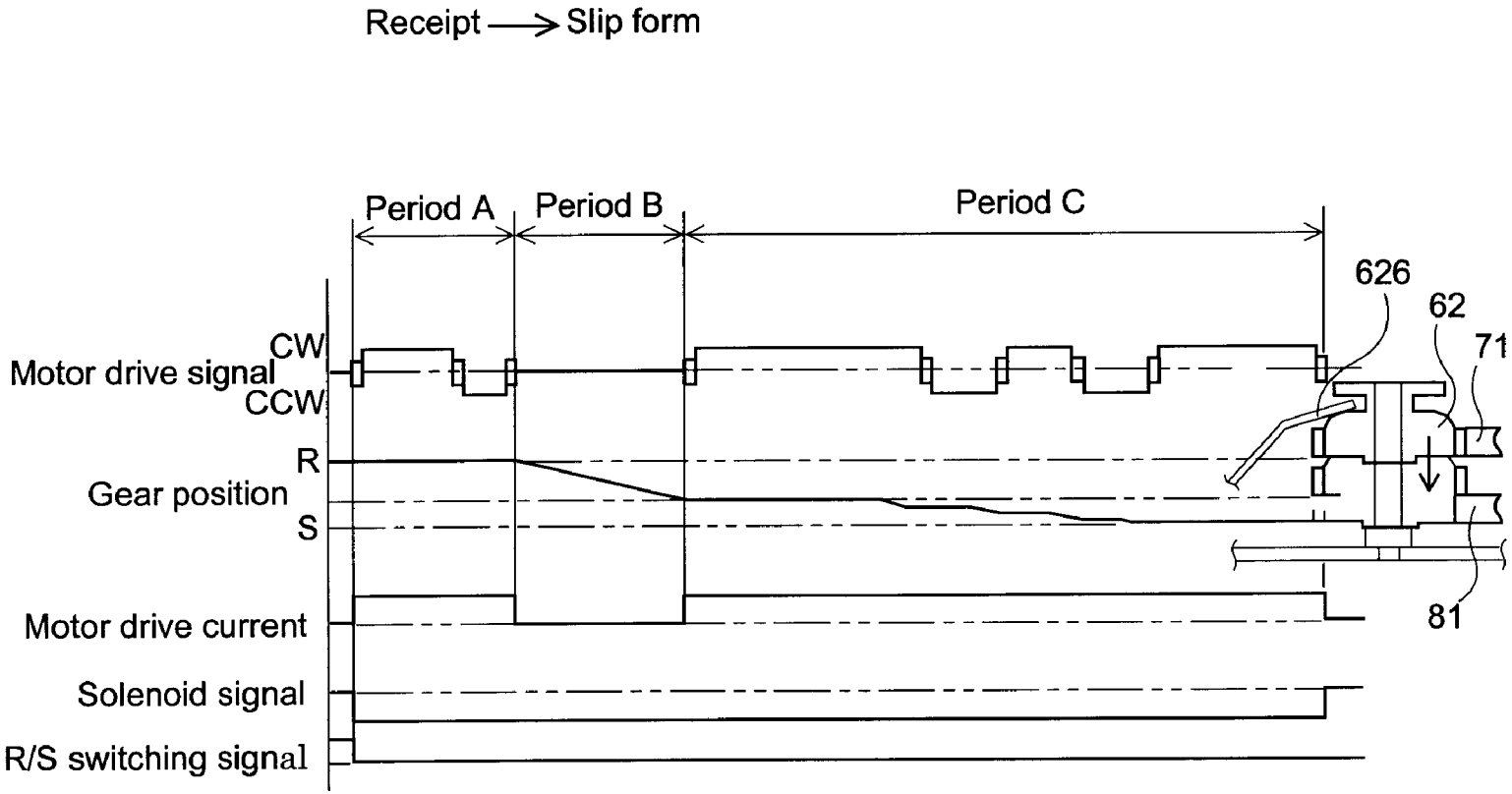
FIG. 5 is a timing chart of the operation changing the drive force transfer mechanism of the printer shown in FIG. 1 from the roll paper drive side to the slip form drive side.
Figure 6:
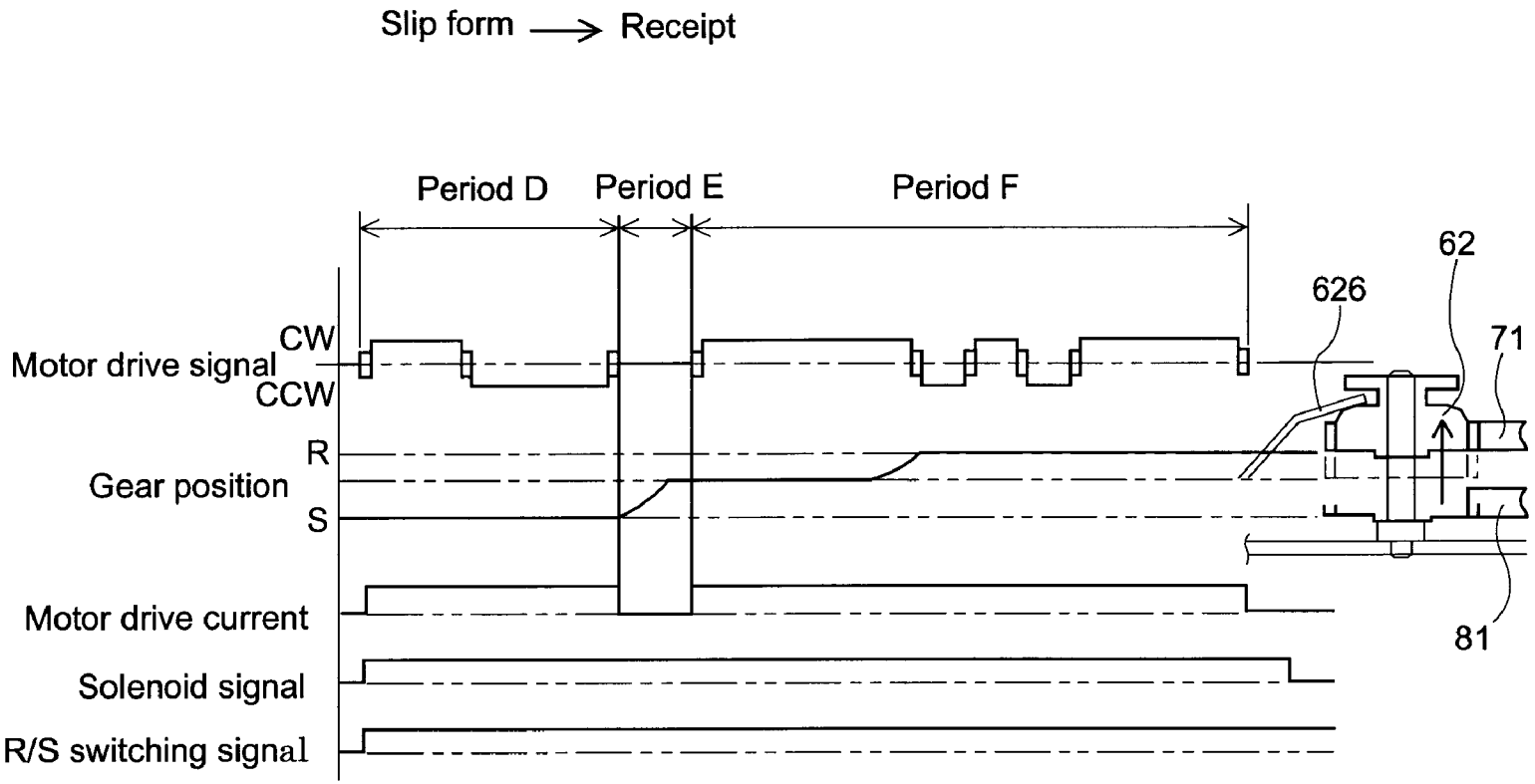
FIG. 6 is a timing chart of the operation changing the drive force transfer mechanism of the printer shown in FIG. 1 from the slip form drive side to the roll paper drive side.

FIGS. 5 and 6 are timing charts referred to below to describe the receipt to slip form switching operation whereby the switching gear 62 is moved from the roll paper transportation position to the slip form transportation position shown in FIG. 4, and the slip form to receipt switching operation whereby the switching gear 62 is moved from the slip form transportation position to the roll paper transportation position, respectively.

As will be known from these timing charts, switching the switching gear 62 between the roll paper transportation position and slip form transportation position, referred to below as R/S switching, is activated by an R/S switching signal. This R/S switching signal contains a cover unlocked signal output from a detector for detecting whether the opening/closing cover is locked or unlocked as described more fully below. Note, further, that the R/S switching signal can also be generated manually using an appropriate manual switch.

When the R/S switching signal is applied, the drive motor 61 is driven forward and in reverse (clockwise and counterclockwise) to adjust the position at; which the switching gear 62 turns so that switching gear 62 separates from the gear 71 or 81 with which it is engaged. (Timing periods A and D in FIGS. 5 and 6, respectively). Depending on whether the switching gear 62 is engaged with gear 71 or 81 at the start of this operation, switching gear 62 slides along shaft 62*a* in either period A or D, and separates from gear 71 or 81. It is important to note, however, that the switching gear 62 will not necessarily disengage from gear 71 or 81 within period A or D. There is therefore a delay (periods B and E) of a specified time during which the controller for driving the clutch waits for the switching gear 62 to separate completely from gear 71 or 81. The drive motor 61 is then again turned forward and reverse to slide and adjust the position of switching gear 62 so that it engages the other gear 81 or 71.

It should be further noted that in this exemplary embodiment of the present invention the drive train is normally set to the roll paper transportation side, and switching gear 62 is normally held in the position indicated by the solid line in FIG. 4A. As will be described more fully below, when the cover unlocked signal indicating that the opening/closing cover of roll paper loading mechanism 2 is open is applied, the switching gear 62 is slid to the position indicated by the dotted line in FIG. 4A by means of the clutch mechanism, thereby switching the drive train to the slip form transportation side. It is yet further important to note that by thus switching the drive train, the gear train for roll paper transportation is released from the rotation constraining force of the drive motor 61.

As a result, the last drive gear 73 in the roll paper transportation gear train 97 on the printer side, and the paper feed gear 31 on the cover that engages drive gear 73, are disengaged and can turn freely. The operating force required to release engagement of both gears in order to open the cover is thus small, and the cover can be opened easily with little force.

Roll Paper Loading Mechanism

Figure 7:
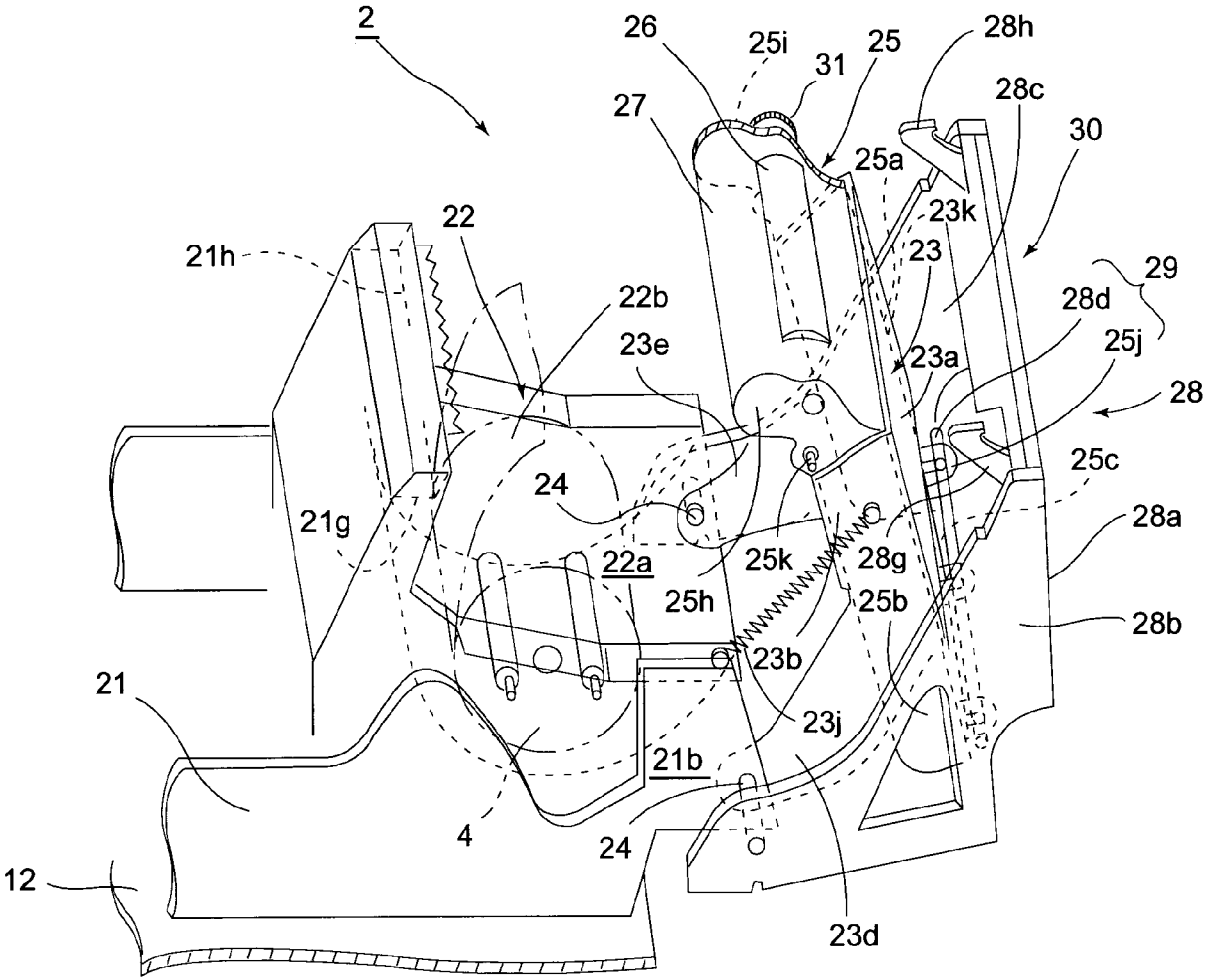
FIG. 7 is a partial perspective view of the roll paper loading mechanism in the ink jet printer shown in FIG. 1.

The roll paper loading mechanism 2 of this exemplary embodiment of the present invention is described next with reference to FIGS. 7 to 12. FIG. 7 is a perspective view of the roll paper loading mechanism 2 in the ink jet printer shown in FIG. 1, FIGS. 8 to 11 are various views illustrating the opening and closing of the roll paper holder of the roll paper loading mechanism 2, and FIG. 12 shows the slide frame for the cover frame of the roll paper loading mechanism in FIG. 7.

Referring to these figures, roll paper loading mechanism 2 has a mounting frame 21 affixed to the printer frame 12. This mounting frame 21 comprises a roll paper holder 22 into which roll paper 4 is loaded. The roll paper holder 22 has a semicircular curved part 22*a* of a specific width, and a rectangular opening 22*b* above the curved part 22*a*. Roll paper 4 can be replaced or loaded from this opening 22*b*.

The opening 22*b* for roll paper loading can be opened by means of an opening/closing cover 30 comprising a first cover frame 23, slide frame 25, and cover frame 28.

The first cover frame 23 has a top plate part 23*a* with substantially the same rectangular shape as the opening 22*b*, and sides 23*b* and 23*c*, which have a specific height and are formed by bending the right and left sides of top plate part 23*a* perpendicularly to the top.

The back end of each side 23*b* and 23*c* extends further downward, forming bottom ends 23*d* and 23*e*. These bottom ends 23*d* and 23*e* are rotationally supported on a shaft 24 around which the first cover frame 23 pivots. The ends of shaft 24 are supported by mounting frame 21. The first cover frame 23 can thus pivot around this shaft 24 between a closed position (shown in FIG. 8) whereat the first cover frame 23 closes the roll paper loading opening 22*b* to the roll paper holder 22, and an open position (shown in FIG. 11) whereat the opening 22*b* is open and unobstructed.

Slide frame 25 is further mounted to this first cover frame 23. This slide frame 25 both pivots in conjunction with the first cover frame 23 and slides relative to the first cover frame 23. The platen roller 26 and paper guide 27 for guiding roll paper 4 to the platen roller 26 are mounted at the front edge of the slide frame 25.

The means whereby slide frame 25 is mounted slidably to the first cover frame 23 is described next with reference to FIGS. 12A and 12B. Note that first cover frame 23 and slide frame 25 are shown upside down in FIG. 12A. The slide frame 25 has a rectangular top plate 25*a* that contacts the inside of the top plate part 23*a* of first cover frame 23, and sides 25*b* and 25*c*, which have a specific height and are formed by bending the right and left sides of top plate 25*a* perpendicularly to the top. Guide slots 25*d* and 25*f* are formed front to back to the top plate 25*a*. Guide pins 23*q* and 23*r* fixed to top plate part 23*a* of first cover frame 23 pass through these guide slots 25*d* and 25*f*. A snap ring 23*h* and 23*i* is then attached at the bottom end of these guide pins 23*q* and 23*r* to hold the slide frame 25 so that it can slide on the inside of first cover frame 23 as shown in FIG. 12A.

A coil spring 23*g* is connected between the rear guide pin 23*r* and a spring catch 25*g* disposed at the front end of the slide frame 25. The tension of this coil spring 23*g* constantly pulls back on the slide frame 25.

Referring again to FIG. 7, the platen roller 26 is disposed between front ends 25*h* and 25*i* of sides 25*b* and 25*c* of the slide frame 25 with the ends of the platen roller shaft rotationally supported at the front ends 25*h* and 25*i*. A paper guide 27 is formed below the platen roller 26 and has a convex circular arc shaped surface tangential to the outside surface of platen roller 26.

Figure 8:
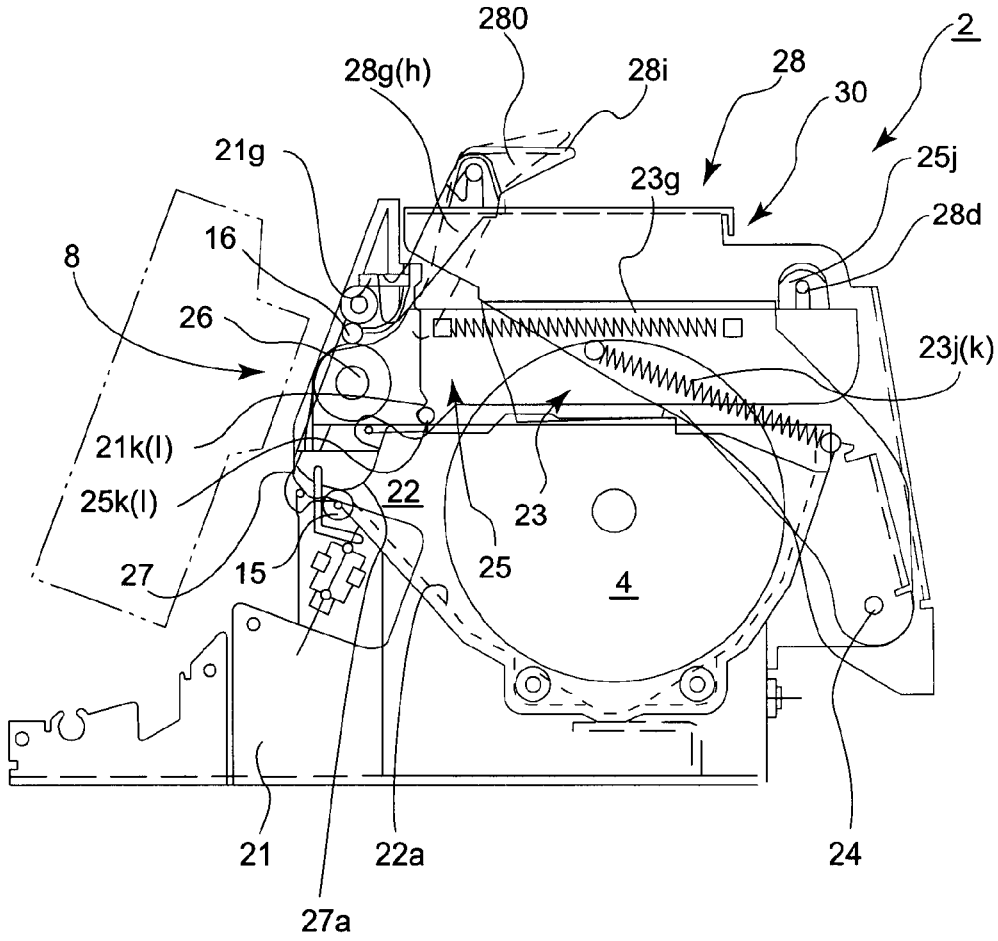
FIG. 8 is a side view showing the roll paper holder of the roll paper loading mechanism in FIG. 7 closed.

As shown in FIG. 8, when the platen roller 26 supported at the end of slide frame 25 is at the platen roller operating position, pressure roller 16 on the printer presses against the outside surface of the platen roller 26 with a specific elastic force. More specifically, the center shaft 16*a* (FIG. 13) of pressure roller 16 can be moved slightly in directions approaching and separating from platen roller 26, and is normally urged to platen roller 26 by spring tension. Therefore, when the platen roller 26 is positioned to its operating position in resistance to this spring tension, roll paper 4 is pressed against the outside surface of the platen roller 26 by means of pressure roller 16 as a result of this constant spring tension. Roll paper 4 thus held between these two rollers can then be advanced by rotationally driving platen roller 26.

Referring to FIG. 8, when platen roller 26 is in the operating position, surface 27*a* of paper guide 27, which is likewise disposed at the end of the slide frame 25, likewise displaces pressure roller 15, also mounted on the printer, in resistance to the elastic force of the roller. Pressure roller 15 thus pushes with constant force against this surface 27*a* of paper guide 27 with the roll paper 4 disposed therebetween.

Figure 9:
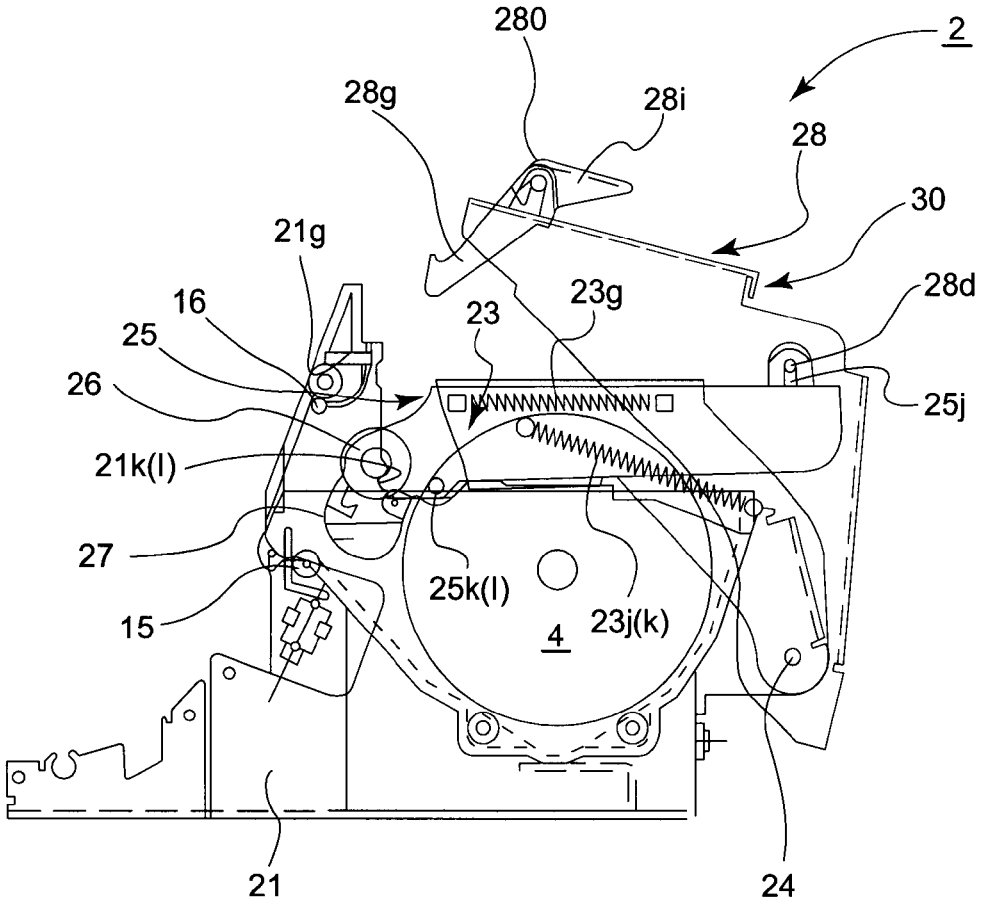
FIG. 9 is a side view showing the roll paper holder of the roll paper loading mechanism in FIG. 7 closed when the cover frame lock is released.

A slightly larger second cover frame 28 is further disposed over first cover frame 23. This second cover frame 28 comprises top panel 28*a* and sides 28*b* and 28*c*, which are bent perpendicularly from both sides of top panel 28*a*. The back ends of sides 28*b* and 28*c* extend further downward, and are pivotably supported on shaft 24. When this second cover frame 28 is pivoted, first cover frame 23 attached to slide frame 25 also pivots. After the first cover frame 23 closes to the roll paper loading opening 22*b* as shown in FIG. 9, the second cover frame 28 continues to pivot independently. This independent pivoting action of the second cover frame 28 causes the slide frame 25 to slide forward or back relative to the first cover frame 23.

Turning back to FIG. 7, a linkage mechanism 29 for converting independent pivoting of the second cover frame 28 to the sliding action of the slide frame 25 comprises a connecting shaft 28*d* and three oval connecting holes 25*j*. The connecting shaft 28*d* spans the distance between the sides 28*b* and 28*c* of second cover frame 28 at a position above and at the back of the second cover frame 28. Referring to FIG. 8, the connecting holes 25*j* are provided at the back of slide frame 25. The connecting shaft 28*d* passes through the connecting holes 25*j*. The long axis of the oval connecting holes 25*j* is oriented substantially perpendicularly to the slide frame 25 so that the connecting holes 25*j* do not interfere with the independent pivoting action of the second cover frame 28.

As a result, when the first cover frame 23 has closed the roll paper loading opening 22*b* as shown in FIG. 9, the connecting shaft 28*d* is positioned so that when the second cover frame 28 is further pivoted to the horizontal position shown in FIG. 8, the connecting shaft 28*d* moves downward and forward of the center of shaft 24 defining the center of rotation.

When the connecting shaft 28*d* moves freely downward through vertically long oval connecting holes 25*j*, the connecting holes 25*j* are also pushed forward. This causes the entire slide frame 25 to which connecting holes 25*j* are fixed to also move forward. More specifically, slide frame 25 slides forward on first cover frame 23, thus projecting platen roller 26 and paper guide 27 on the front end thereof into the printing position 11 with a specific gap held to the opposing ink jet head 8 whereby printing is accomplished. This position is referred to herein as the operating position.

When the second cover frame 28 is conversely pivoted from the horizontal position shown in FIG. 8 to the position shown in FIG. 9, the movements described above are reversed. That is, the slide frame 25 slides to the back, and the platen roller 26 and paper guide 27 at the front end thereof are retracted from the operating position to a retracted position.

As noted above the slide frame 25 is urged constantly in the retracting direction by coil spring 23*g*. The tension of the extended coil spring 23*g* thus causes the slide frame 25 to return to the retracted position when the force holding the second cover frame 28 horizontal and closed as shown in FIG. 8 is released. This sliding action also causes the second cover frame 28 to pivot in the opening direction to the attitude shown in FIG. 9.

A locking lever 280 is disposed to a front part of the second cover frame 28 as a means of locking the second cover frame 28 in the closed position shown in FIG. 8. When the second cover frame 28 is thus closed, hooks 28*g* and 28*h* formed on the end of each locking lever 280 engage a corresponding catch 21*g* and 21*h* on the edge of the opposing mounting frame 21. Note that the hooks 28*g* and 28*h* engage the catches 21*g* and 21*h* by rotating back and engaging the catches 21*g* and 21*h* from below. A torsion spring (not shown in the figure) constantly urges locking lever 280 in the direction causing the hooks to rotate forward and up against the catches.

Therefore, when the second cover frame 28 is closed further from the position shown in FIG. 9, hooks 28*g* and 28*h* are forced to pivot slightly back in resistance to the torsion spring until the hooks clear the edge of the corresponding catch and then travel forward and up again to engage the respective catch 21*g* and 21*h* on the mounting frame 21. To release the lock, end 28*i* of the locking lever 280 is raised, thereby causing the hook on the bottom end of the locking lever 280 to rotate downward and disengage the catch.

A roll paper loading mechanism 2 according to this preferred embodiment also has a mechanism for precisely positioning the platen roller 26 on the end of slide frame 25 to the operating position when the second cover frame 28 is closed as described above. More specifically, positioning pins 25*k* and 25*l* project horizontally to both sides at the front of sides 25*b* and 25*c* of slide frame 25. Corresponding to these positioning pins 25*k* and 25*l* on the mounting frame 21 are semicircular channels 21*k* and 21*l* so that when the slide frame 25 is closed the positioning pins 25*k* and 25*l* slide horizontally into the positioning channels 21*k* and 21*l*.

It is to be noted that the position of these channels 21*k* and 21*l* is fixed. As a result, fitting the positioning pins 25*k* and 25*l* of the slide frame 25 into these channels 21*k* and 21*l* accurately restricts the position of the platen roller 26 on the end of the slide frame 25 to the operating position. When the platen roller 26 is in this operating position, the platen roller surface becomes the printing surface against which paper is held in the printing position 11. The ink jet head 8 travels bidirectionally from side to side with a specific gap held to the printing surface. As a result, a constant gap can be held between the platen roller 26 and the nozzle face of the ink jet head 8.

A coil spring 23*j* and 23*k* (only 23*j* is shown in the figures) is stretched between the sides 21*b* and 21*c* of the mounting frame 21 and the corresponding sides 23*b* and 23*c* of the first cover frame 23. These coil springs 23*j* and 23*k* are disposed such that when the second cover frame 28, slide frame 25, and first cover frame 23 are opened and closed pivoting on shaft 24 and pass the pivot position shown in FIG. 10 where the center of gravity of the frames is directly above shaft 24, the distance between the catches on the ends of each spring increases as the frames 28, 25, and 23 continue to move.

Figure 10:
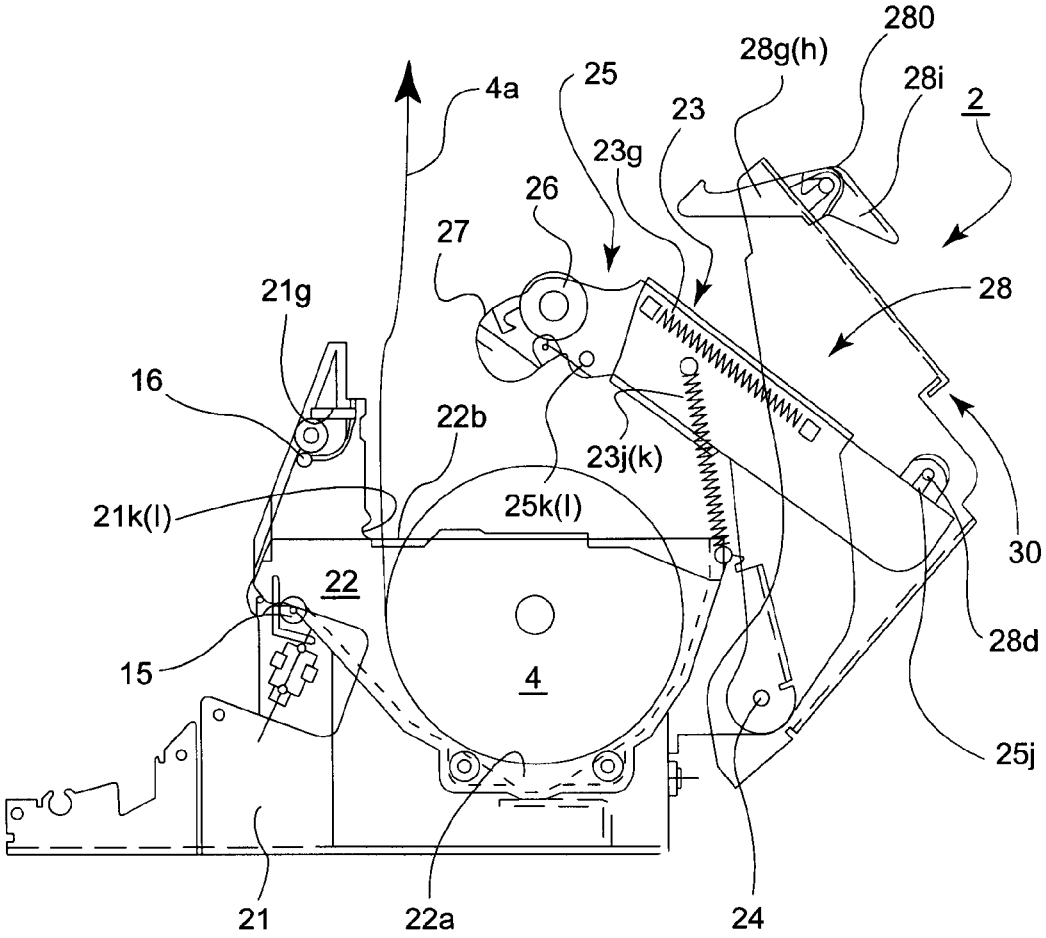
FIG. 10 is a side view showing the cover frame of the roll paper loading mechanism in FIG. 7 opened almost vertically.

This means that when the second cover frame 28 is opened beyond the pivot position shown in FIG. 10, the coil springs 23*j* and 23*k* stretch, creating spring tension pulling the second cover frame 28 in the closing direction. This prevents the second cover frame 28 from springing open rapidly and forcefully, and thus avoids potential damage caused by the frame 28 striking another object.

Likewise when the second cover frame 28 is closed beyond the pivot position shown in FIG. 10, the coil springs 23*j* and 23*k* stretch, creating spring tension preventing the second cover frame 28 from closing forcefully and thus avoiding damage resulting from the frame 28 striking the opening 22*b* to the roll paper holder.

Locked/Unlocked Detection Mechanism for the Opening/Closing Cover

A printer 1 according to this preferred embodiment further comprises a locked/unlocked detection mechanism for detecting whether the opening/closing cover 30 is locked in the closed position or whether the lock has been released.

Figure 13:
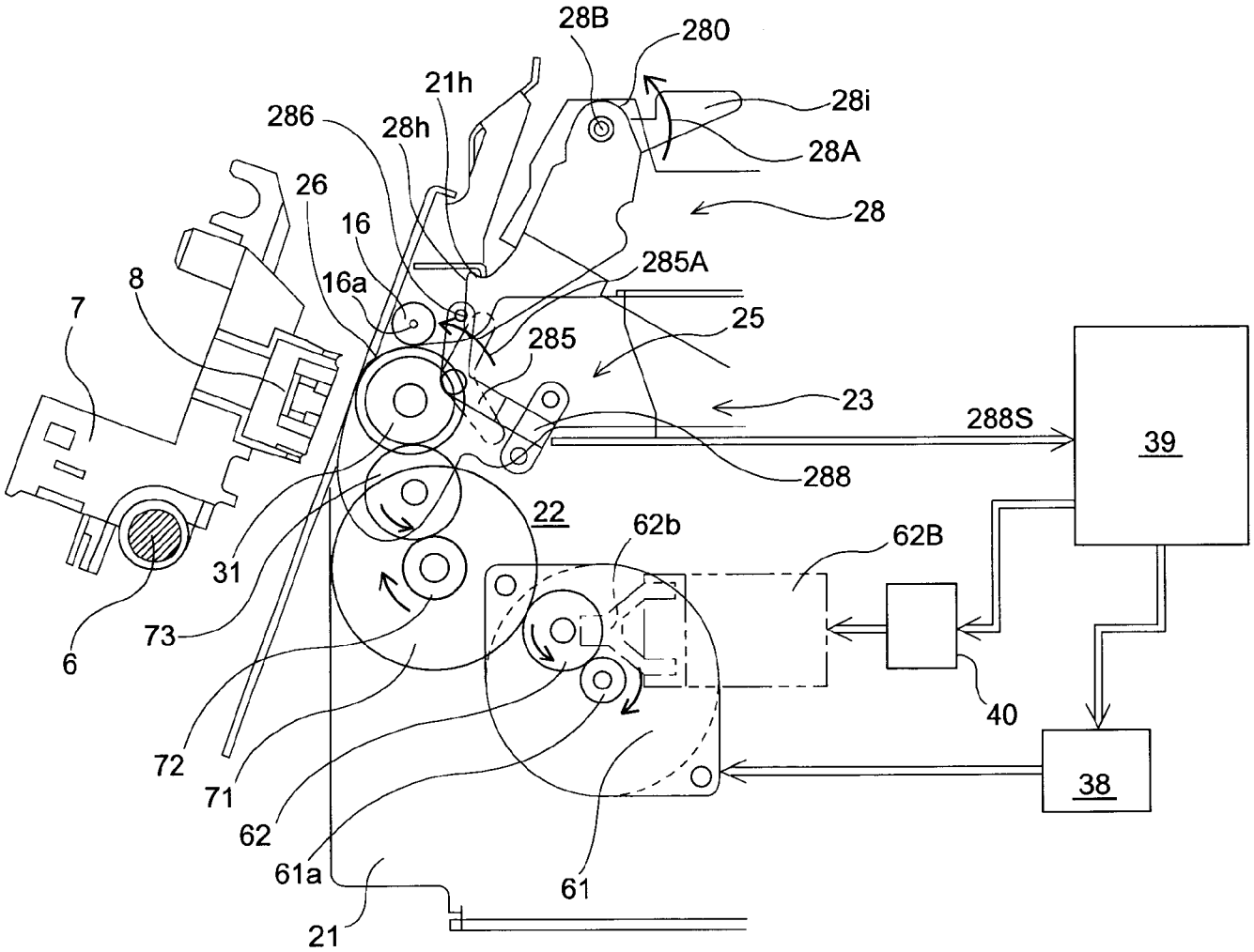
FIG. 13 shows the characteristic parts of the mechanical parts of the printer shown in FIG. 1 in conjunction with the control system therefor.
Figures 14A, 14B, 14C:
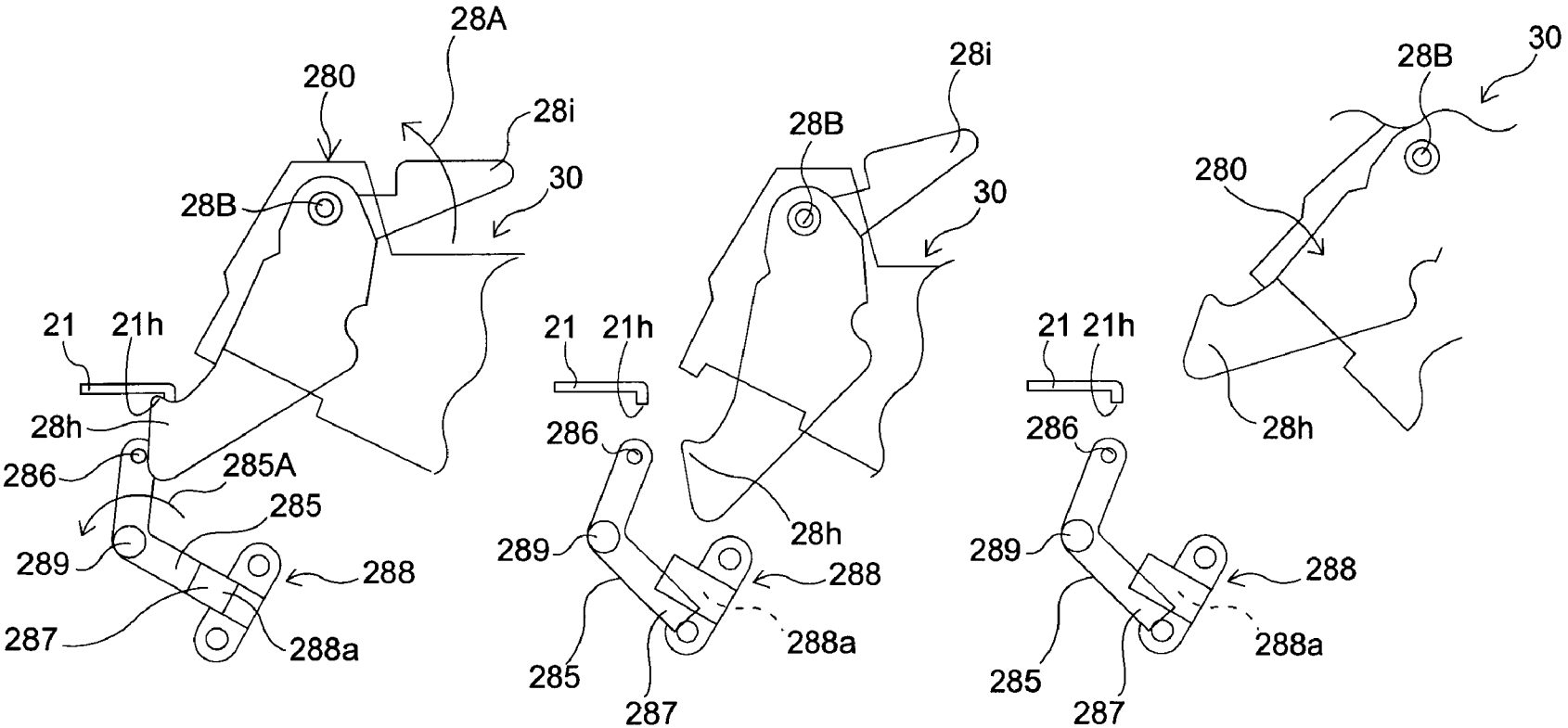
FIGS. 14A–14C show the operation of a detecting mechanism for detecting locking and unlocking of the cover to the printer shown in FIG. 1.

FIG. 13 shows the part of this printer where the locked/unlocked detection mechanism is mounted, and the major components of the printer control system. FIGS. 14A–14C show the operation whereby this detection mechanism works. It is to be noted that this locked/unlocked detection mechanism is omitted from FIGS. 1 to 12 for the convenience of showing the other component parts.

The locked/unlocked detection mechanism detects whether the locking lever 280 is locked to the mounting frame 21 or has been released from the locked position. As shown in FIG. 13, the locked/unlocked detection mechanism comprises a basically L-shaped pivoting lever 285, which pivots on its axis of rotation when pushed by the hook 28*g*, 28*h* of the corresponding locking lever 280, and a photointerrupter 288 for detecting the pivoting lever 285. The pivoting lever 285 and photointerrupter 288 are supported on the mounting frame 21.

The pivoting lever 285 is more specifically pivotably supported on a pivot pin 289 attached at the bend in the pivoting lever 285. The pivoting lever 285 is also normally urged in the direction opposite arrow 285A shown in FIG. 13 by a spring (not shown in the figure). An engaging pin 286 is disposed at the top end of pivoting lever 285. When the opening/closing cover 30 is closed, this engaging pin 286 contacts the front edge of one locking lever hook 28*h* . As the opening/closing cover then continues to close, hook 28*h* pushing against this engaging pin 286 causes pivoting lever 285 to pivot in the direction of arrow 285A to the position indicated by the solid line in FIG. 13.

As noted above, when the second cover frame 28 is completely closed, the hooks 28*g* and 28*h* of the locking lever 280 engage the corresponding catch 21*g* and 21*h* on the mounting frame 21 and lock, thus holding the opening/closing cover 30 in the closed position. This locked position is shown in FIG. 14(*a*).

When the pivoting lever 285 is in this opening/closing cover 30 locked position shown in FIG. 14A, the other end 287 of the pivoting lever 285 is inserted to the detection range 288*a* of the photointerrupter 288. The photointerrupter 288 thus outputs a detection signal 288S (referred to below as the cover locked detection signal) indicating that the hook 28*h* of the locking lever 280 is locked.

When the opening/closing cover 30 is then opened by lifting the end 28*i* of locking lever 280 up in the direction of arrow 28A shown in FIG. 13 and FIG. 14A from the locked position, the locking lever hooks 28*g* and 28*h* pivot around axis 28B and separate from the catches 21*g* and 21*h* on the mounting frame 21.

When the lock is thus released, the above-noted spring tension returns the pivoting lever 285 to the initial unlocked position as shown in FIG. 14B and by the dotted line in FIG. 13, thus also removing the other end 287 from the detection range 288*a* of the photointerrupter 288. The output level of the photointerrupter output signal thus changes, and the photointerrupter 288 outputs a detection signal 288S indicating that the locking lever 280 is now unlocked (referred to as cover unlocked singal).

When the locking lever 280 is thus unlocked, the opening/closing cover 30 is moved toward its fully open position by the applied spring tension as described above. FIG. 14C shows the opening/closing cover 30 when it has pivoted slightly towards the full open position.

Controller

FIG. 13 shows the controller and corresponding mechanical parts of the ink jet printer 1 shown in FIG. 1 according to this preferred embodiment of the present invention.

The controller of this ink jet printer 1 comprises a drive control unit 39 typically having a microprocessor with a CPU, ROM for storing the program run by the CPU, and working RAM, similarly to a common ink jet printer. That is, the controller described below is achieved by means of primarily the same CPU, ROM, and RAM as conventional printers with the CPU performing the process for reducing or releasing the constraining force on the paper feed gear described below according to a program stored in ROM and/or RAM.

It is to be further noted that drive control of the ink jet head 8 and paper feed control of roll paper and slip forms by this drive control unit 39 are substantially the same as in a common ink jet printer. Further description and presentation in the accompanying figures is therefore omitted herein where only those parts associated with drive control as it relates to the present invention are described.

The drive control unit 39 controls drive motor 61 by means of motor driver 38, and controls operation of the solenoid 62B by means of driver 40. The detection signal 288S generated and output by the photointerrupter 288 of the locked/unlocked detection mechanism as described above is supplied to the drive control unit 39.

When the opening/closing cover 30 is closed and locked, drive gear 73 and paper feed gear 31 are engaged and thus constrain opening the cover 30 as described above. When it is detected that this lock has been released, the drive control unit 39 performs an operation for disengaging the meshed drive gear 73 and paper feed gear 31 and thus releasing the force constraining opening the opening/closing cover. This operation is referred to below as a constraint releasing operation.

To accomplish this operation, the means for reducing or releasing the constraining force of this preferred embodiment of the invention is realized by the drive control unit 39 driving the above-noted clutch mechanism to switch the drive train downstream from the drive motor 61 from the roll paper transportation gear train to the slip form transportation gear train. As shown in FIG. 4A, this clutch mechanism comprises solenoid 62B; switching gear 62, which can be slid between the roll paper and slip form transportation positions by the solenoid 62B; first gear 71, which is in the gear train engaging the switching gear 62 when in the roll paper transportation position; and first gear 81, which is in the gear train engaging the switching gear 62 when in the slip form transportation position.

Operation of the Roll Paper Loading Mechanism

Opening and closing roll paper holder 22 of the roll paper loading mechanism 2 in a ink jet printer 1 according to this preferred embodiment is described next below with reference to FIGS. 8 to 11, 13, and 14.

First, when the top end 28*i* of the locking lever 280 is pulled up when the roll paper holder 22 is closed as shown in FIG. 8 and FIG. 13, the right and left hooks 28*g* and 28*h* on the locking lever disengage from the catch 21*g* and 21*h* of the mounting frame 21. The lock is thus released.

The pivoting lever 285 therefore leaves the detection range 288*a* of the photointerrupter 288, and the photointerrupter 288 thus detects that the opening/closing cover 30 lock has been released. More specifically, the detection signal of the photointerrupter 288 is output as a cover unlocked detection signal to the drive control unit 39 of the ink jet printer 1.

When the drive control unit 39 detects this signal, it applies a drive signal to the solenoid 62B of the clutch mechanism, thereby causing the switching gear 62 to slide from the roll paper transportation position (indicated with a solid line in FIG. 4) to the slip form transportation position (indicated with a dotted line in FIG. 4). This switching operation follows the sequence shown in FIG. 5.

The roll paper transportation gear train (gears 71 to 73 and 31) is thus disengaged from the drive train connected to the drive motor 61, thereby reducing or releasing the constraining force preventing free gear rotation. The drive gear 73 on the printer and the paper feed gear 31 engaged therewith are thus both able to turn freely. It is therefore possible to easily disengage the meshed drive gears. As a result, the opening/closing cover 30 can also be opened with little force.

When the lock is thus released and the opening/closing cover 30 opened, the second cover frame 28, slide frame 25, and first cover frame 23 of the opening/closing cover 30 pivot in conjunction to the position shown in FIG. 9. This pivoting operation is accomplished primarily by the tension of coil spring 23*g* stretched between slide frame 25 and first cover frame 23.

Figure 11:
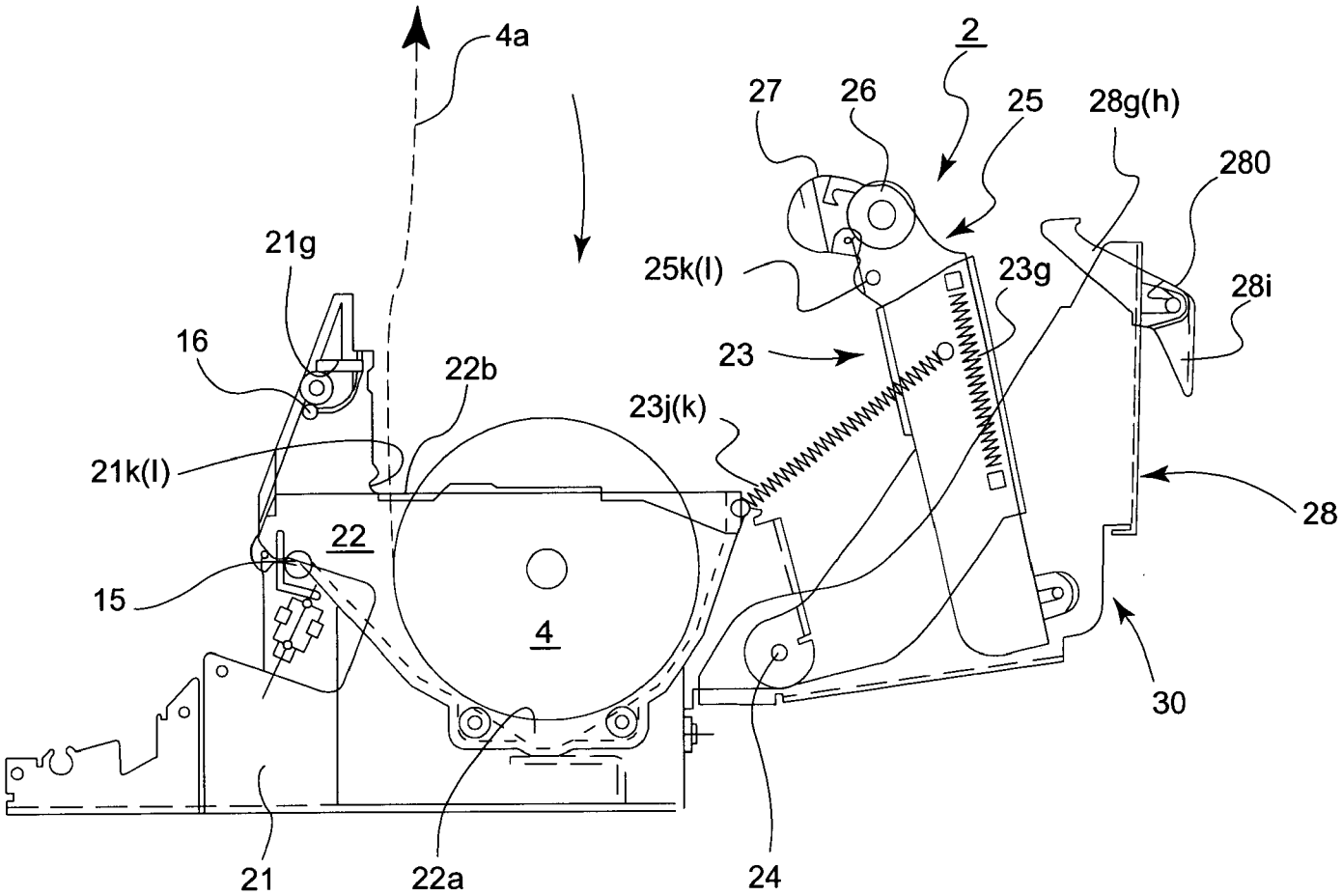
FIG. 11 shows the roll paper holder of the roll paper loading mechanism in FIG. 7 fully opened.

When the second cover frame 28 is then pivoted further to the back through the position shown in FIG. 10 to the position shown in FIG. 11 in resistance to the tension of coil springs 23*j* and 23*k*, the opening 22*b* to roll paper holder 22 is completely open. That is, the second cover frame 28, slide frame 25, and first cover frame 23 are retracted from above the opening 22*b*.

After thus fully opening the roll paper holder, the roll paper 4 in the curved roll paper loading part 22*a* can be replaced. The roll paper 4 can also be easily placed into and removed from the roll paper holder because the opening 22*b* thereto is unobstructed. It is also easy to position the leader 4*a* from the roll paper 4 because the platen roller 26 and paper guide 27 are also removed from the roll paper holder with the slide frame 25.

After loading roll paper 4, the second cover frame 28 is rotated in the closing direction. The second cover frame 28, slide frame 25, and first cover frame 23 thus pivot together through the position shown in FIG. 10 until the first cover frame 23 closes the opening 22*b* as shown in FIG. 9. The first cover frame 23 thus engages the edge of the opening 22*b* and pivots no further. The slide frame 25 disposed slidably on the first cover frame 23 also pivots no further. The second cover frame 28 therefore pivots independently as it continues to close from this position.

When the second cover frame 28 is then pushed to pivot to the position shown in FIG. 8, the pivoting motion of the frame is converted by linkage mechanism 29 to the sliding motion of slide frame 25. That is, the slide frame 25 slides forward relative to the first cover frame 23 to the operating position at which the platen roller 26 and paper guide 27 supported at the front of the slide frame 25 are held with a specific gap to the ink jet head 8.

When the slide frame 25 slides forward, the positioning pins 25*k* and 25*l* at the front sides of the slide frame 25 fit into the channels 21*k* and 21*l* in the mounting frame 21, thus fixing the sliding position. In other words, the channels 21*k* and 21*l* assure that the platen roller 26 and paper guide 27 are held in a predetermined position at which a specific gap to the ink jet head 8 is established and held.

Sliding the slide frame 25 forward also causes the drive gear 31 on one end of the platen roller 26 to move horizontally forward and completely engage drive gear 73 by the time it moves from the side to a position directly above the drive gear 73 on the mounting frame 21.

At this point the locking lever hooks 28*g* and 28*h* are locked to the frame-side catches 21*g* and 21*h*. The pivoting lever 285 in the front of the hook 28*h* on one side thus pivots, causing the bottom other end 287 to interrupt the detection range 288*a*, of the photointerrupter 288. It is thus detected that the opening/closing cover 30 is closed and locked and the photointerrupter 288 outputs the cover locked detection signal 288S.

When the drive control unit 39 then detects this cover locked detection signal, it drives the solenoid 62B of the clutch mechanism to slide the switching gear 62 from the slip form transportation position (dotted line in FIG. 4) to the roll paper transportation position (solid line in FIG. 4). The operating sequence in this case is as shown in FIG. 6. This operation completes the drive train for roll paper transportation. Thereafter, the drive control unit 39 controls driving drive motor 61 through motor driver 38 to advance the roll paper and synchronously drive the ink jet head 8 to print as desired to the roll paper.

Alternative Embodiment of a Controller

When the controller of the ink jet printer 1 described above generates the cover unlocked detection signal, the drive train is switched to the slip form side to alleviate or remove or reduce the constraining force acting on the cover-side form feed gears and preventing the gears from turning freely.

Figure 15:
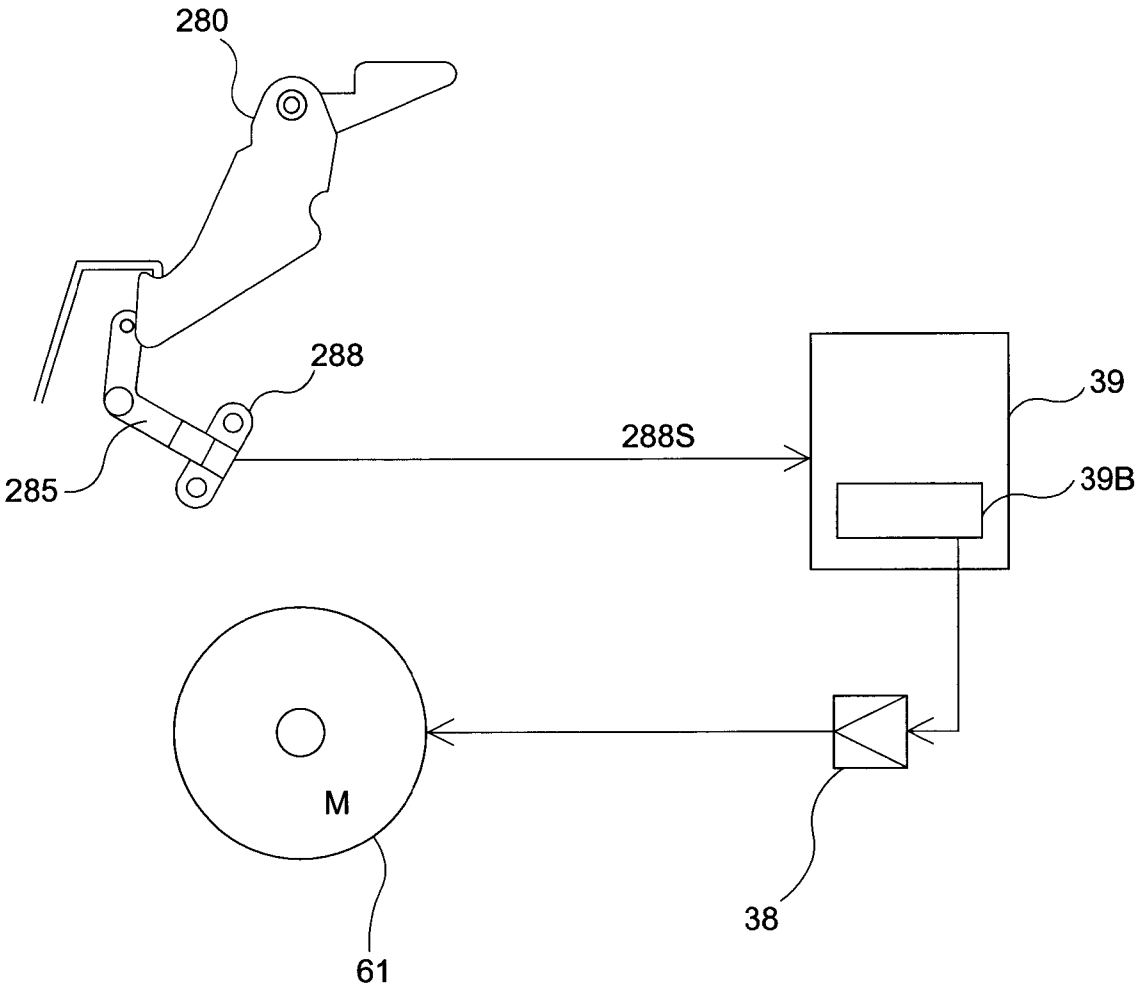
FIG. 15 shows an alternative means for disengaging constraining force.

It is alternatively possible as shown in FIG. 15, for example, for this controller to stop supplying the holding current whereby drive motor 61 rotation is held in a fixed position, thereby allowing the drive motor to turn freely, when the photointerrupter 288 detects that the opening/closing cover is unlocked. This can be accomplished by the motor controller 39B of the drive control unit 39.

This configuration also effectively reduces or releases the constraining force of drive motor 61 on the roll paper transportation gear train. Little force is therefore required to disengage the paper feed gear 31 on the opening/closing cover 30 side from the drive gear on the printer side.

Using the motor controller 39B of the drive control unit 39, the controller can also be comprised to actively disengage the paper feed gear 31 on the opening/closing cover 30 side and the drive gear 73 on the printer by driving the drive motor 61 in the reverse of the paper transportation direction for a specified time when the photointerrupter 288 detects the opening/closing cover to be unlocked.

In this case, too, the paper feed gear 31 on the opening/closing cover 30 side can be disengaged from the drive gear on the printer side with little force required.

This configuration is particularly advantageous when the roll paper jams. More specifically, when the roll paper jams the roll paper is typically stuck in the gap between the platen roller 26 and the member opposing the outside surface of the platen roller 26. When this happens the platen roller 26 cannot turn, and the paper feed gear 31 affixed coaxially to the platen roller 26 also cannot turn. As a result, the opening/closing cover 30 to which the platen roller 26 is attached cannot open.

To recover from such a paper jam, the opening/closing cover 30 must be opened and the jammed roll paper removed. Even though the opening/closing cover 30 will not open at this time, the locking lever 280 can be pivoted to the unlocked position (indicated by the dotted line in FIG. 8), thereby causing the cover unlocked detection signal to be output from the photointerrupter 288.

When the motor controller 39B of the drive control unit 39 detects this signal, the drive motor 61 is driven in reverse for a specific time by the motor driver 38. Roll paper stuck between the platen roller 26 and the member opposite the outside surface thereof can thus be removed, and the platen roller 26 can again be turned.

If the opening/closing cover 30 is opened in conjunction with driving the motor in reverse, the cover-side paper feed gear 31 and printer-side drive gear 73 can be easily disengaged. It is thus even easier to open the opening/closing cover 30.

It is to be noted that while the above preferred embodiment of the present invention has been described with reference to a printer for printing to both roll paper and slip forms, the invention shall not be so limited and can obviously be adapted for use with roll paper printers capable of printing only to roll paper. In this case the mechanism for switching the drive train needs only to disengage the roll paper drive gear train from the drive motor.

As described above, a printer according to the present invention has a controller for disengaging a paper feed gear on the opening/closing cover side and a corresponding drive gear on the printer side to reduces or release the constraining force of the drive motor on the cover-side gear when the opening/closing cover lock is unlocked. The controller accomplishes this by interrupting the supply of a holding current to the drive motor linked to the roll paper transportation gear train, physically disengaging the drive motor from this gear train, or driving the drive motor for a specific time in the direction opposite the roll paper advancing direction.

A preferred controller for a printer capable of bidirectional printing to both roll paper and slip forms according to the present invention disengages and releases the constraint of the printer-side drive gear on the cover-side paper feed gear by switching the drive motor from engagement with the roll paper transportation gear train to the slip form transportation gear train when the opening/closing cover lock is released.

When opening the printer cover, it is therefore possible by means of the present invention to disengage the paper feed gear on the opening/closing cover from the drive gear on the printer using little force, thereby making it easier to open the opening/closing cover.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

While the present invention is applicable to a variety of different printer structures, it is particularly advantageous in case of the embodiment explained above in which the paper feed gear 31 engages the drive gear 73 (or disengages from it) while moving in a direction substantially tangential to the drive gear. Because the platen roller 26 and the paper feed gear 31 are mounted on the slide frame 25, the axis of paper feed gear 31 performs a translational motion relative to the drive gear 73 as the two gears are engaged with or disengaged from one another. The drive gear is located at such position that the locus of paper feed gear's axis during the engaging and disengaging motion is parallel to a line more or less tangential to the drive gear. Therefore, more relative rotation between the two gears is required to engage or disengage them as may be the case if the two gears are arranged such that the locus of the paper feed gear during engagement and disengagement is a line radial to the drive gear or at least having a greater component in the drive gear's radial direction.

What is claimed is:

1. A printer for printing on a roll of paper, comprising;

a roll paper holder having an opening for loading the roll of paper;

a cover supported on said roll paper holder movable between a first position in which said cover covers said opening and a second position in which said cover exposes the opening;

a feed roller;

a first gear which is attached to said cover together with said feed roller and coupled to said feed roller;

a first gear train including a second gear mounted on said roll paper holder;

a motor to rotationally drive said feed roller via said first gear train, wherein said first gear is engaged with said second gear when said cover is in the first position, wherein said first gear is disengaged from said second gear when said cover is in the second position, wherein said first gear is arranged to rotate relative to said second gear when said cover is in the first position, and wherein said second gear rotates in a first direction to advance said roll paper when driven by said motor, a controller to set said second gear to a rotatable state so as to rotate in a second direction opposite the first direction when said cover is moved from the first position to the second position.

2. The printer according to claim 1 further comprising:

a cover lock having a locked position when said cover is in the first position and an unlocked position;

a detector for detecting when said cover lock is in the unlocked position; and wherein said controller sets said second gear to the rotatable state when said detector detects that said cover lock is in the unlocked position.

3. The printer according to claim 2, wherein said controller stops supply of a holding current to said motor when said detector detects that said cover lock is in the unlocked position.

4. The printer according to claim 2, wherein said controller drives said motor for a specific time in a second direction opposite the first direction when said detector detects that said cover lock is in the unlocked position.

5. The printer according to claim 2, further comprising a clutch, wherein said controller sets said clutch to disengage said first gear train from said motor when said detector detects that said cover lock is in the unlocked position.

6. The printer according to claim 5, wherein said clutch comprises:

a solenoid; and a switching gear, wherein said first gear train comprises a third gear, and wherein said solenoid moves said switching gear between a first position where said switching gear engages said third gear of said first gear train and a second position at which said switching gear is separated from said first gear train.

7. The printer according to claim 2, further comprising:

a slip form feed roller;

a second gear train to transfer motor rotation from said motor to said slip form feed roller; and a clutch to selectively engage said motor to said first gear train or said second gear train;

wherein said controller drives said clutch to engage said motor to said second gear train when said detector detects that said cover lock is in the unlocked position.

8. The printer as set forth in claim 7, wherein said clutch comprises:

a solenoid; and a switching gear, wherein said first gear train comprises a third gear, wherein said second gear train comprises a fourth gear, wherein said solenoid moves said switching gear between a first position in which said switching gear engages said third gear of said first gear train and a second position in which said switching gear engages said fourth gear of said second gear train.

9. The printer according to claim 2, wherein said lock comprises:

a locking lever for locking said cover in the first position;

a pivot pin pivotably supporting said locking lever to pivot between a locked position and an unlocked position;

a hook formed as part of said locking lever; and a catch disposed on said roll of paper holder for catching said hook when said locking lever reaches the locked position.

10. The printer as set forth in claim 9, wherein said detector comprises a pivoting lever, and an optical sensor for detecting said pivoting lever, said pivoting lever pivotably supported in said roll of paper holder so that said pivoting lever is positioned in a detection range of said optical sensor when said locking lever is in the locked position, and moves out from the detection range when said locking lever is unlocked.

11. A control method for a printer having a roll of paper holder including an opening for loading a roll of paper, a cover allowed to move between a first position where the opening is closed and a second position where the opening is open, a roll paper feed roller attached to the cover, a motor for rotationally driving the roll paper feed roller, a first gear train for transferring rotation from the motor to the roll of paper feed roller, the first gear train having a first gear mounted to the roll paper holder and a second gear mounted to the cover, the second gear engaging the first gear when the cover is the first position; said method comprising the steps of:

engaging the first gear with the second gear when the cover is in the first position;

disengaging the first gear from the second gear when the cover is in the second position;

rotating the first gear relative to the second gear when the cover is in the first position;

rotating the second gear in a first direction to advance the roll paper when driven by the motor; and setting the second gear to a rotatable state so as to rotate in a second direction opposite the first direction when the cover is moved from the first position to the second position.

* * * * *

UNITED STATES PATENT AND TRADEMARK OFFICE

CERTIFICATE OF CORRECTION

PATENT NO. : 6,345,782 B1
DATED : February 12, 2002
INVENTOR(S) : Hiroyuki Nakayama et al.

It is certified that error appears in the above-identified patent and that said Letters Patent is hereby corrected as shown below:

Title page,
Item [56], References Cited, U.S. PATENT DOCUMENTS, please add
-- 5,791,796 * 8/1998 --

Signed and Sealed this

Fifteenth Day of October, 2002

*Attest:*

*Attesting Officer*

JAMES E. ROGAN
*Director of the United States Patent and Trademark Office*